US009206578B1

(12) United States Patent
Rose

(10) Patent No.: US 9,206,578 B1
(45) Date of Patent: Dec. 8, 2015

(54) GROUND ROD DRIVING TOOL

(71) Applicant: Rick Rose, Dry Ridge, KY (US)

(72) Inventor: Rick Rose, Dry Ridge, KY (US)

( * ) Notice: Subject to any disclaimer, the term of this patent is extended or adjusted under 35 U.S.C. 154(b) by 0 days.

(21) Appl. No.: 14/705,120

(22) Filed: May 6, 2015

Related U.S. Application Data

(63) Continuation-in-part of application No. 14/453,748, filed on Aug. 7, 2014, now Pat. No. 9,051,705.

(51) Int. Cl.
*B25D 1/00* (2006.01)
*B25D 1/16* (2006.01)
*E02D 7/04* (2006.01)

(52) U.S. Cl.
CPC ... *E02D 7/04* (2013.01); *B25D 1/16* (2013.01)

(58) Field of Classification Search
CPC ..... B25D 1/00; B25D 1/16; E02D 1/04; E02D 7/04
USPC ..... 173/1, 90–91; 227/147
See application file for complete search history.

(56) References Cited

U.S. PATENT DOCUMENTS 5,181,644 A * 1/1993 Ferrell ..... 227/147
5,248,002 A * 9/1993 Williams ..... 173/1

* cited by examiner

*Primary Examiner* — Michelle Lopez
(74) *Attorney, Agent, or Firm* — Witters & Associates; Steve Witters

(57) ABSTRACT

A ground rod driving tool and method of use is presently disclosed. The ground rod driving tool has a longitudinally extending first component part with a ground rod stop and a sleeve extending from the stop, the sleeve is configured to slidingly receive a portion of a ground rod. A longitudinally extending second component part has a first end and a second end, wherein the first end is configured to cooperate with an end portion of a ground rod and the second end may have a guide rod extending therefrom.

20 Claims, 13 Drawing Sheets

GROUND ROD DRIVING TOOL

CROSS-REFERENCE TO RELATED APPLICATIONS

This application claims the benefit of U.S. application Ser. No. 14/453,748, entitled "GROUND ROD DRIVING TOOL", filed Aug. 7, 2014, which is hereby incorporated herein by reference in its entirety.

FIELD OF THE DISCLOSURE

This disclosure relates generally to ground rod driving tools, and more specifically tools configured to drive a ground rod a desired depth into the ground.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ground rods are designed to carry current away from an electrical surge and route it safely into the ground. For example, ground rods are often a component part of a lightning protection system for protecting a structure in event of a lighting strike. A typical lighting protection system comprises a ground rod, wire, and a lightning rod or other feature configured and disposed with the structure for conduction of electricity from lightening and grounding to earth. For example, if lightning strikes the structure, it will preferentially be conducted to ground, through the wire, instead of passing through the structure where it could start a fire or cause electrocution.

A ground rod is an electrode installed in the ground to provide a low resistance electrical path to ground or earth. Grounding rods are often required by law, and where they are not required by law, they are in common use because they are excellent safety devices which are affordable to install. A grounding rod typically consists of a long rod made of conductive material, such as copper or copper alloy, which is driven into the ground. A length of eight feet is typically standard, with the rod being substantially fully driven into the ground wherein it minimizes a tripping hazard. Once the ground rod is driven into the ground, it can be connected to a lightning rod, or other electrical system, with the use of a ground connector and a wire.

Ground rods typically must be driven into the ground to provide an electrical grounding to earth. Often, problems are associated with driving ground rods into the ground and these problems may be exemplified when the ground is hard.

SUMMARY

In at least one aspect of the present disclosure, a ground rod driving tool is disclosed. The ground rod driving tool has a longitudinally extending first component part comprising a ground rod stop and a sleeve extending from the stop. The sleeve is configured to slidingly receive a portion of a ground rod. A longitudinally extending second component part comprises a head with a first end and a second end. The first end of the head of the second longitudinally extending component part is configured to cooperate with an end of a ground rod. The second end of the head of the longitudinally extending second component part has a guide rod extending therefrom. The guide rod is configured to be slidingly received by the sleeve of the first component part. The first component part has a mass sufficient to drive a ground rod into the ground by sliding the sleeve about the ground rod and impinging the ground rod with the ground rod stop. The first component part is configured to drive a ground rod into the ground by sliding the sleeve about the guide rod and impinging the second end of the head of the longitudinally extending second component part.

In another aspect of the present disclosure, a method for driving a ground rod into the ground is disclosed. The method comprises the steps of: positioning a first end of a ground rod end on ground; receiving a portion of a second end of the ground rod with a sleeve longitudinally extending from a first component part of a ground rod driving tool; repeatedly sliding the sleeve up and down about the second end of the ground rod and impinging a ground rod stop, thereby transferring the momentum of the first component part of the ground rod driving tool to the ground rod and driving the ground rod into the ground until the sleeve becomes proximate the ground; removing the first component part of the ground rod driving tool from the ground rod; receiving a guide rod extending from a second end of a head of a second component part of the ground rod driving tool in the sleeve; cooperating a first end of the head of the second component part with the ground rod; and repeatedly sliding the sleeve up and down about the guide rod and impinging the second end of the head, thereby transferring the momentum of the first component part to the second component part, and then to the ground rod and driving the ground rod into the ground until the second end of the ground rod becomes proximate to the ground.

In a further aspect of the present disclosure, a ground rod driving tool is disclosed. The ground rod driving tool has a longitudinally extending first component part comprising a sleeve configured to receive a portion of a ground rod and a ground rod stop. A longitudinally extending second component part has a first longitudinal end and a second longitudinal end, wherein the first longitudinal end is configured to cooperate with an end of a ground rod. The first component part and the second component part are configured to couple and uncouple with each other, and have their longitudinal axes aligned upon coupling. The first component part has a mass sufficient to drive a ground rod into the ground by sliding the sleeve about the ground rod and impinging the ground rod stop. The second component part is configured to transfer a driving force to a ground rod and drive the ground rod into the ground.

BRIEF DESCRIPTIONS OF THE DRAWINGS

The following figures, which are idealized, are not to scale and are intended to be merely illustrative of aspects of the present disclosure and non-limiting. In the drawings, like elements are depicted by like reference numerals. The drawings are briefly described as follows.

DETAILED DESCRIPTION

The ground rod driving tool of the present disclosure is configured for driving a ground rod substantially completely into the ground or below grade. The ground rod driving tool comprises two component parts which may be separated from one another. The ground rod driving tool is configured to first drive the ground rod into the ground wherein a length, such as more than a foot, of the ground rod extends from the ground. The two components may then be separated and one component part may be placed upon the ground rod extending from the ground. The ground rod may then be driven a desired depth into the ground. It may be desired to drive the ground rod substantially completely into the ground. For example, it may be desired to only leave a sufficient length of the ground rod above grade for connecting a ground wire with a connector. Alternatively, it may be configured to drive the ground rod with or below grade.

Reference will now be made in detail to the present exemplary embodiments and aspects of the present invention, examples of which are illustrated in the accompanying figures.

Figure 1:
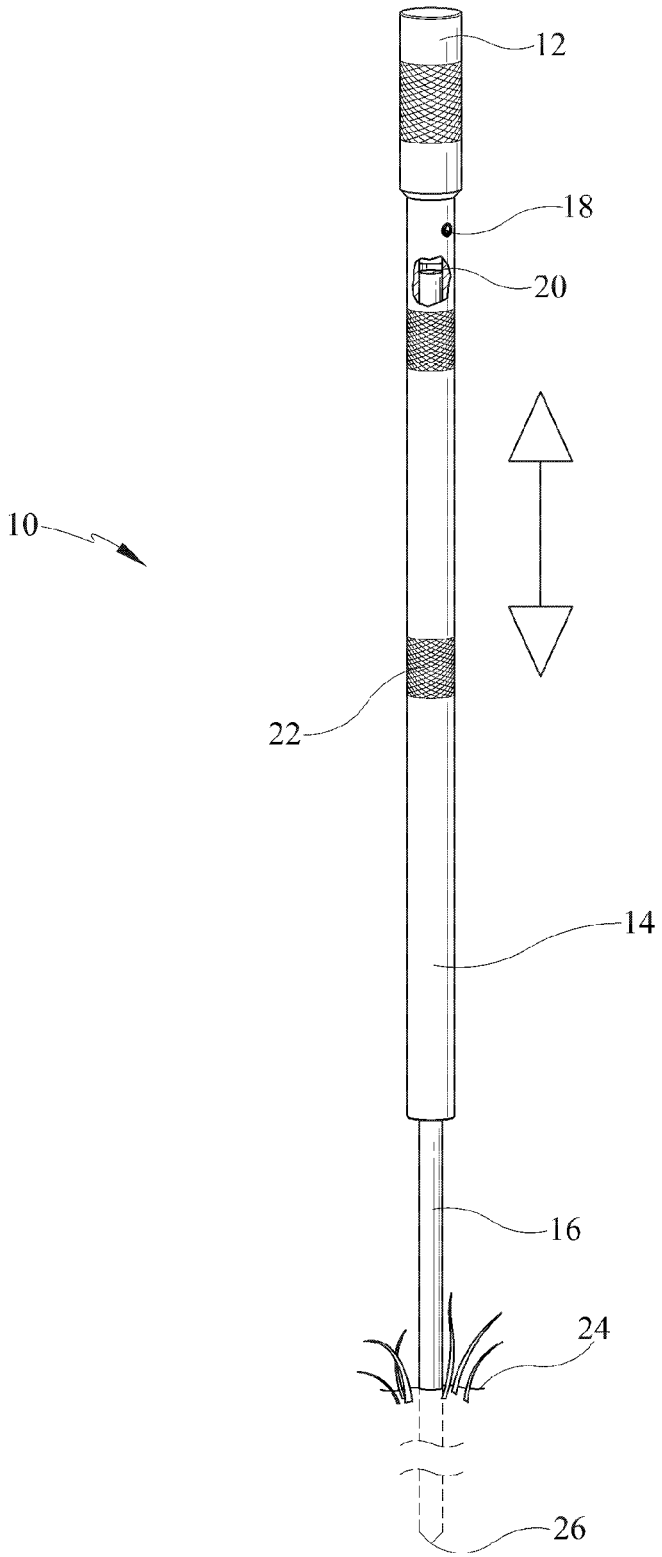
FIG. 1 is a perspective view of a ground rod driving tool of the present disclosure having a cut-away portion and showing function.

FIG. 1 shows ground rod driving tool 10 of the present disclosure driving ground rod 16 into the ground 24. Ground rod driving tool 10 comprises a longitudinally extending first component part 14 comprising a sleeve closely receiving a portion of ground rod 16. Longitudinally extending second component part 12 is removably coupled with a first longitudinal end of longitudinally extending first component part 14. First component part 14 and second component part 12 are coupled with each other and have their longitudinal axes aligned.

Figure 4:
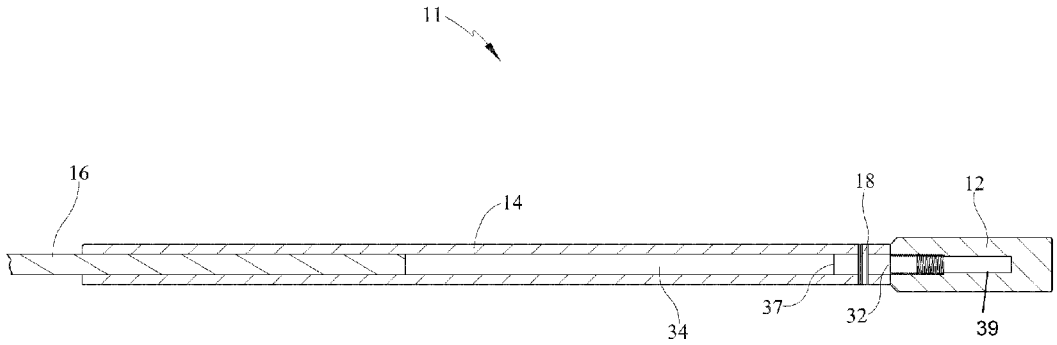
FIG. 4 is a cross-sectional view of the ground rod driving tool of the present disclosure showing cooperation of its component parts.

The mass of the coupled first and second component parts, 12 and 14, is sufficient to drive a ground rod into the ground by sliding the sleeve about the ground rod 16 and impinging a second ground rod end 20 with a ground rod stop 33, shown in FIG. 4. In at least one aspect of the present disclosure, ground rod driving tool 10 has a mass in a range of about 5 pounds to about 25 pounds. For example, ground rod driving tool may have a mass in a range of about 15 pounds to about 18 pounds. As shown in FIG. 1, ground rod driving tool 10 may be moved up and down, as indicated with the double headed arrow, to drive first end 26 of ground rod 16 into ground 24.

Optionally, outer portions of first component part 14 and/or second component part 12 may be knurled or have other features for gripping, 22.

Figure 2:
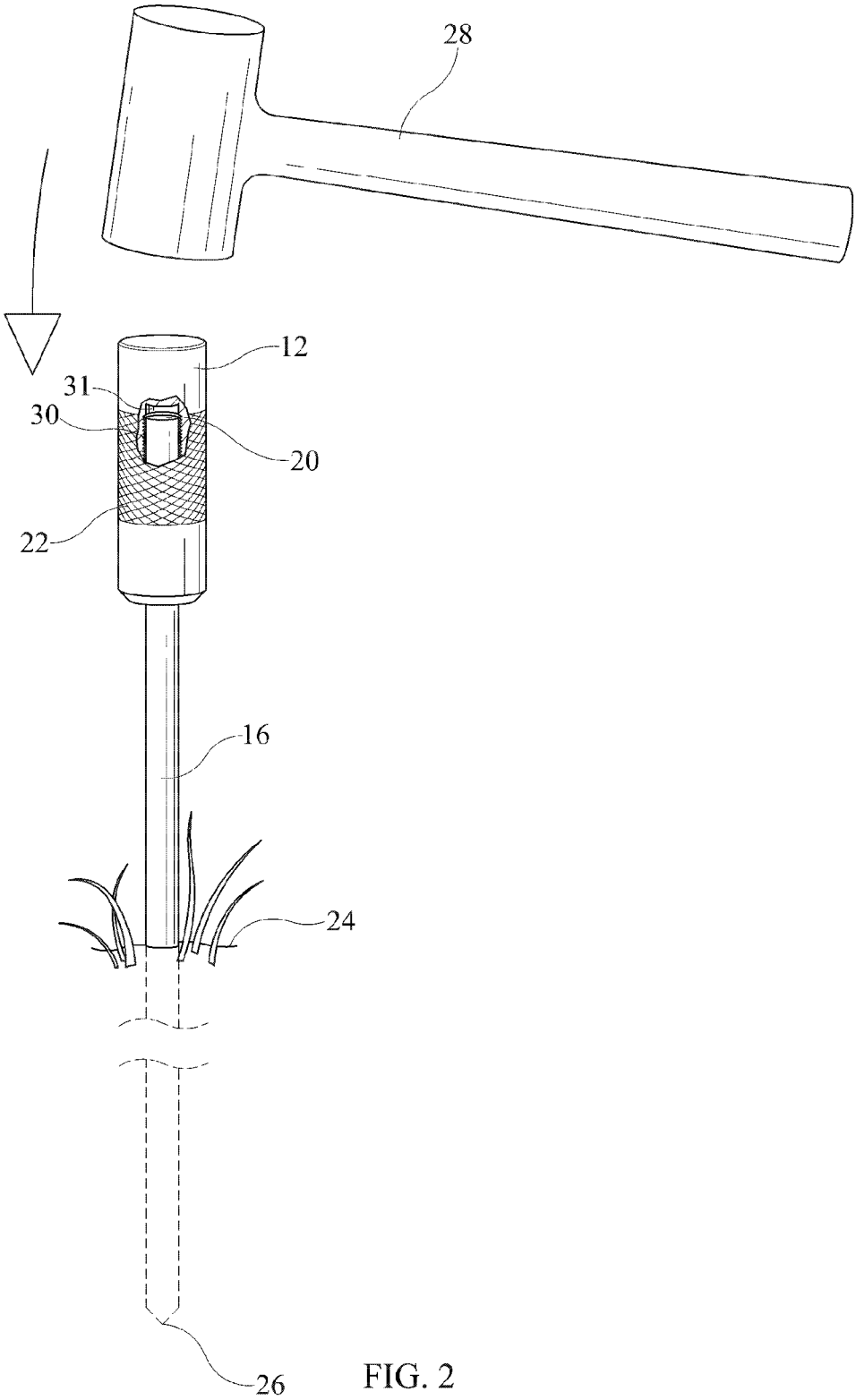
FIG. 2 is a perspective view of a portion of the ground rod driving tool of the present disclosure having a cut-away portion and showing further function.

FIG. 2 is a perspective view of second component part 12 of ground rod driving tool 10 showing its further function. Upon driving ground rod 16 into the ground 24 with ground rod driving tool 10, as shown in FIG. 1, about 2-4 feet of ground rod 16 may remain above grade or surface of ground 24. Second component part or ground rod cover 12 may then be removed from first component part 14 and placed about second ground rod end 20 of ground rod 16, as shown in FIG. 2. Placement of second component part 12 about ground rod 16 provides for the further driving of ground rod 16 into ground 24. For example, a hammer 28 may be used to strike a longitudinal end of second component part 12 until ground rod 16 is at grade, below grade, or has a desired length above grade of ground 24. A portion of second component part 12 may be driven below grade until ground rod 16 is at grade, below grade, or is a desired length above grade of ground 24.

Figure 3:
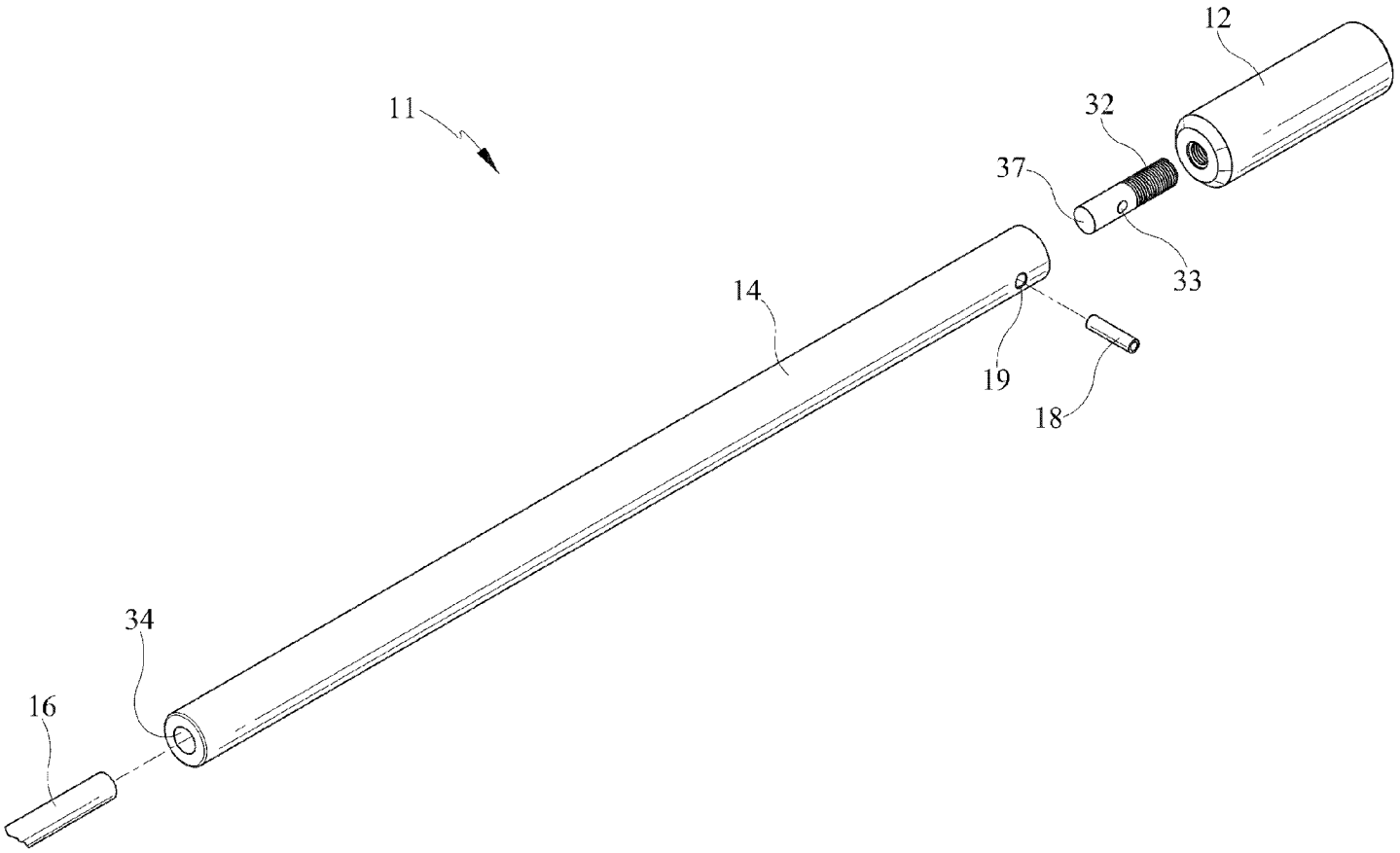
FIG. 3 is a perspective exploded view of the ground rod driving tool of the present disclosure showing its component parts.

FIG. 3 is a perspective exploded view of ground rod driving tool 11 showing its component parts. Ground rod driving tool 11 is void of knurling or other features for gripping. First component part 14 has sleeve portion 34 configured to receive ground rod 16. Second component part 12 is removed from first component part 14 and shows a coupler configured to removably couple first component part 14 with second component part 12. A threaded dowel 32 may be provided with an aperture 33. Threaded dowel 32 may be inserted into a portion of sleeve 34 until aperture 33 aligns with aperture 19 in first component part 14. Upon alignment of the apertures, pin 18 may then be inserted through the apertures and secure threaded dowel 32 in sleeve 34.

FIG. 4 is a cross-sectional view of ground rod driving tool 11 of the present disclosure showing cooperation of its component parts. First component part 14 comprises sleeve 34. Sleeve 34 is shown closely receiving a portion of ground rod 16. Sleeve 34 comprises an end portion 39. End portion 39 has a non-threaded portion of threaded dowel 32 therein. Pin 18 is extending through apertures in threaded dowel 32 and first component part 14, securing a portion of threaded dowel 32 in sleeve 34. Second component part 12 has a bore with a threaded portion 30 and a non-threaded portion 31 extending into a longitudinal end thereof. A portion of threaded dowel 32 is threadingly engaged with threaded portion 30 of second component part 12, thus coupling first component part 14 with second component part 12. An end of threaded dowel 32 provides for stop 37. Stop 37 is configured and disposed to transfer a driving force from ground rod driving tool 11 to ground rod 16.

In at least one aspect of the present disclosure, ground rod driving tool 10 or 11 has a center of gravity within a center third of its length. For example, a ground rod driving tool 11 having a length of 36 inches may have its center of gravity more than 12 inches from each of its longitudinal ends. In at least one aspect, ground rod driving tool 11 has its center of gravity more than 15 inches from each longitudinal end. Having a center of gravity proximate central point, or within a center third of its length, of the ground rod driving tool may ease its use. For example, a user may grip solely its central portion and lift and rotate the ground rod driving tool as desired which may be advantageous in placing sleeve 34 about ground rod 16.

Figure 5:
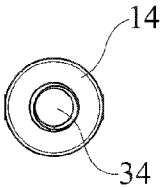
FIG. 5 is an end view of the ground rod driving tool of the present disclosure showing a sleeve.

FIG. 5 shows an end view of first component part 14 of a ground rod driving tool 11 of the present disclosure. As shown in FIG. 5, sleeve 34 has a round inner surface configured to closely receive a ground rod. Ground rods may typically have an outer diameter of about ½ or ⅝ inches. In at least one aspect of the present disclosure, sleeve 34 is round and has a diameter of about ¾ inches. In this aspect, sleeve 34 is configured to closely receive the typical ground rods having an outer diameter of about ½ or ⅝ inches.

Figure 6:
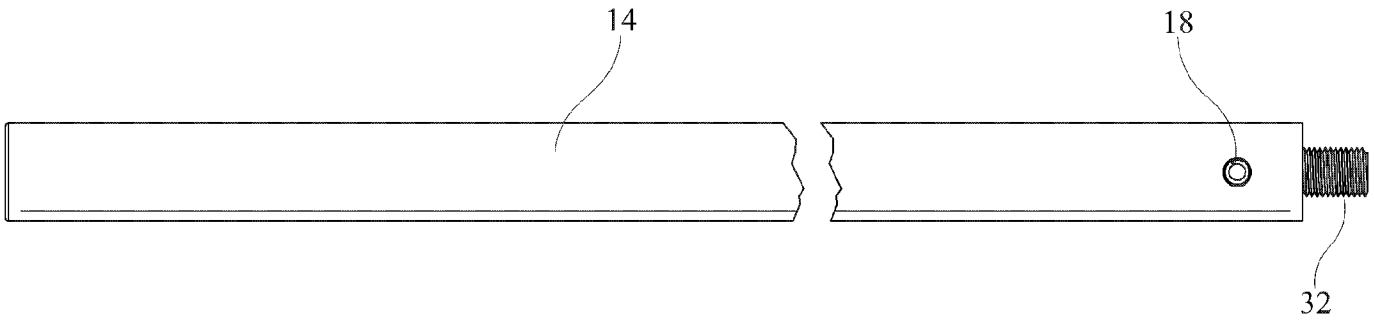
FIG. 6 is a cut-a-way side view of a portion of the ground rod driving tool of the present disclosure.

FIG. 6 is a cut-a-way side view of first component part 14. First component part 14 may have an axial length between about 2 and 4 feet. First component part 14 may comprise cold rolled steel, however other compositions are within the scope of the present disclosure. For example, first component part 14 may comprise hot rolled steel or other materials that provide for strength and mass of the ground rod driving tool sufficient to drive a ground rod into the ground by sliding sleeve 34 about the ground rod and impinging ground rod stop 37, shown in FIG. 4.

Figure 8:
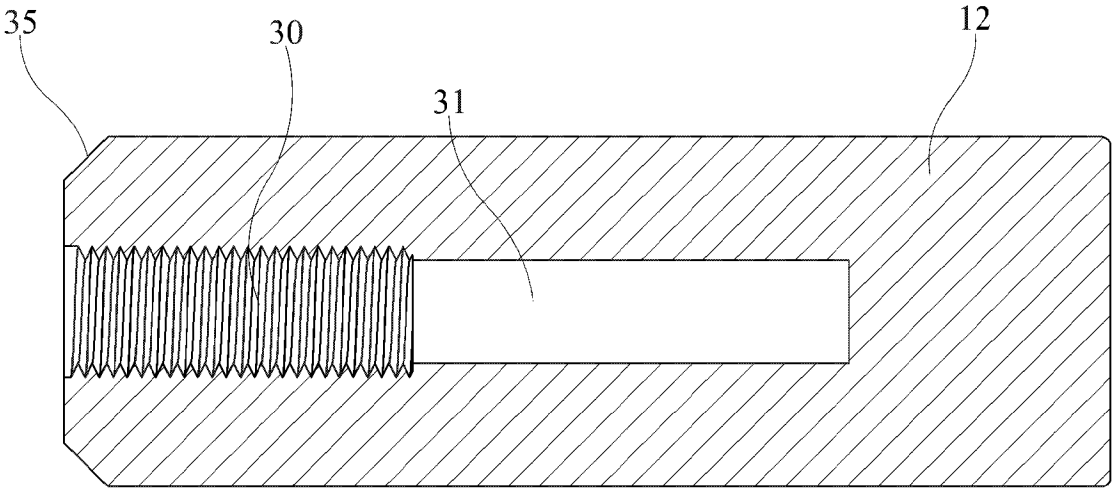
FIG. 8 is a cross-sectional view of the portion of the ground rod driving tool shown in FIG. 7.
Figure 7:
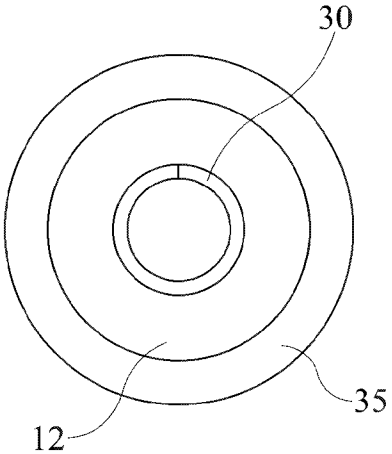
FIG. 7 is an end view of a portion of the ground rod driving tool of the present disclosure.

FIGS. 7 and 8 are end and cross-sectional views of second component part 12 of the ground rod driving tool of the present disclosure. A first longitudinal end of second component part 12 is chamfered with angled portion 35. A female coupler or threaded portion 30 axially extends into the center of the first longitudinal end and is configured to closely receive an end portion of a ground rod and removably couple with a male coupler extending from the first component part. Non-threaded portion 31 axially extends from threaded portion 30 further into the center of the first longitudinal end of second component part 12 and is configured to closely receive an end portion of a ground rod. Threaded portion 30 and non-threaded portion 31 are configured and disposed to closely receive a sufficient length of a ground rod to resist undesired removal of second component part 12 from ground rod 16 upon striking a second longitudinal end of second component part 12, as shown in FIG. 2. In at least one aspect of the present disclosure, the threaded female coupler or threaded portion 30 is configured to contact the ground rod, immediately following hammering a second longitudinal end of second component part 12, and resist separation of second component part 12 from the ground rod.

In at least one aspect of the present disclosure, second component part 12 comprises a malleable material, such as hot rolled steel, and is configured to resist fracture upon being hammered. In this aspect, repeatedly striking second component part 12 may cause the second longitudinal end to deform or "mushroom", instead of fracturing. Since the struck longitudinal end of the second component part 12 is opposite the longitudinal end having the threaded female coupler, or threaded portion 30, the deformation of the struck longitudinal end of second component part 12 may not adversely affect the ground rod driving tool of the present disclosure. For example, a mushroomed longitudinal end of second component part may not interfere with coupling first component part 14 with second component part 12.

Figure 10:
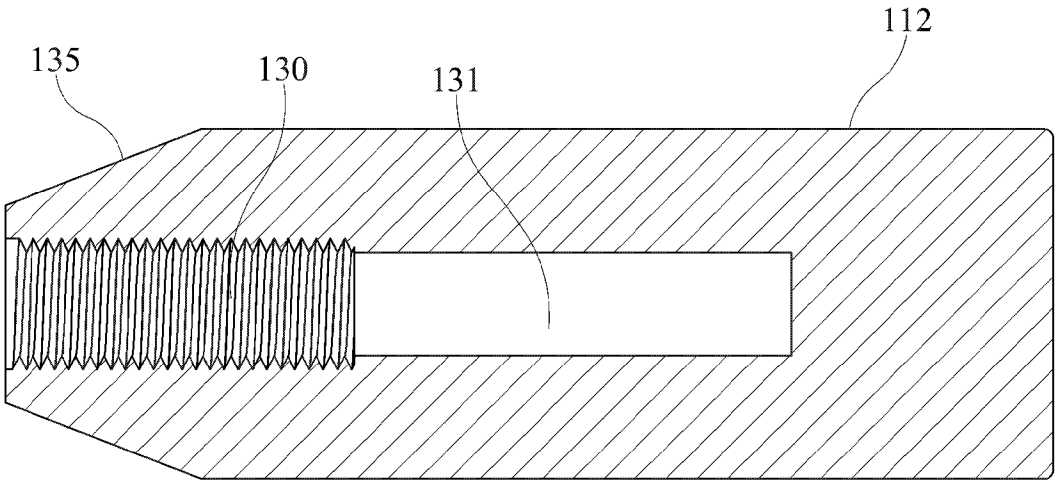
FIG. 10 is a cross-sectional view of the portion of the ground rod driving tool shown in FIG. 9.
Figure 9:
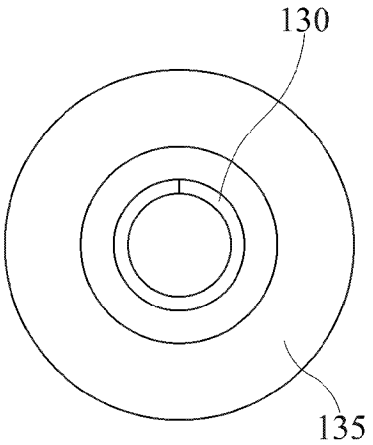
FIG. 9 is an end view of a portion of an alternative embodiment of the ground rod driving tool of the present disclosure.

FIGS. 9 and 10 are end and cross-sectional views of second component part 112 of the ground rod driving tool of the present disclosure. A first longitudinal end of second component part 112 is chamfered with angled portion 135. A female coupler or threaded portion 130 axially extends into the center of the first longitudinal end and is configured to closely receive an end portion of a ground rod and couple, as well as uncouple, with a male coupler extending from the second component part. Non-threaded portion 131 axially extends from threaded portion 130 further into the center of the first longitudinal end of second component part 112 and is configured to closely receive an end portion of a ground rod. Chamfered angled portion 135 is greater than 45°. In this respect, when driving the ground rod further into the ground with second component part 112, as shown in FIG. 2, chamfered angled portion 135 may be advantageous in driving a ground rod completely or almost completely, into the ground, or below grade. For example, chamfered angled portion 135, greater than 45°, may decrease the resistance on second component part 112 when driving second component part 112 into the ground.

With reference to the FIGS., a method for driving a ground rod into the ground is provided. A method for driving a ground rod into the ground comprise axially aligning and coupling a male coupler, such as a portion of threaded dowel 32, of a longitudinally extending first component part 14 of a ground rod driving tool, 10 or 11, with a female coupler, such as threaded portion 30, of a longitudinally extending second component part 12 or 112 of the ground driving tool. First component part 14 of the ground rod driving tool has a sleeve 34 extending from a first longitudinal end configured to receive a portion of a ground rod 16, a ground rod stop 37, and the male coupler, such as a portion of threaded dowel 32, extending from a second longitudinal end. The second longitudinally extending second component part 12 of the ground rod driving tool has the female coupler, such as threaded portion 30, in a first longitudinal end thereof configured to closely receive an end portion of a ground rod 16.

The first ground rod end 26 is positioned on the ground 24. A portion of a second end 20 of ground rod 16 is received with sleeve 34. Sleeve portion 34 of the ground rod drive driving tool is repeatedly slid up and down, as shown with the double headed arrow in FIG. 1, about the second end 20 of ground rod 16 and impinging ground rod stop 37 and second ground rod end 20, thereby transferring the momentum of the ground rod driving tool to ground rod 16 and driving ground rod 16 into the ground until the sleeve 34 becomes proximate the ground 24. At this point, the ground rod driving tool is removed from ground rod 16 by lifting. The second component part 12 of the ground rod driving tool is then removed from the first component part 14. The second component part is then placed about the second ground rod end 20 of ground rod 16 and a portion of the second end of the ground rod 16 is closely received with the female coupler, such as threaded portion 30, of the second component part of the ground rod driving tool. A second longitudinal end of the second component part of the ground rod driving tool is then hammered and the ground rod is driven into the ground until the second end of the ground rod becomes proximate the ground. A portion of the second component part of the ground rod driving tool may be driven into the ground to provide a desired position of ground rod 16 with respect to the surface or grade of the ground 24.

In at least one aspect of the present disclosure, a ground rod driving tool is provided. The ground rod driving tool comprises a longitudinally extending sleeve 34 configured to closely receive an end portion of a ground rod, a stop 37 proximate an end of the longitudinally extending sleeve, and a male coupler 32 longitudinally extending from the end of the sleeve proximate the stop. A longitudinally extending ground rod cover 12 has a female coupler 30, in a longitudinal end thereof, configured to closely receive an end portion of a ground rod. The longitudinally extending sleeve 34 and the longitudinally extending ground rod cover 12 are coupled with their male and female couplers and have their longitudinal axes aligned. Female coupler 30 may be configured to closely receive an end portion of a ground rod. The male 32 and female 30 couplers are cooperatively threaded. The ground rod driving tool may have a mass sufficient to drive a ground rod into the ground by sliding the sleeve about the ground rod and impinging the ground rod stop. The ground rod cover, upon removal from the sleeve and closely receiving an end portion of a ground rod, may be configured to transfer a driving force from a hammer impinging a longitudinal end thereof, to a ground rod and drive the ground rod into the ground. The ground rod cover may be configured to resist fracture upon being hammered. The ground rod cover may comprise malleable hot rolled steel. The ground rod driving tool may have a center of gravity in a central third of its axial length. The longitudinal end of the ground rod cover having the female coupler may be chamfered. The ground rod driving tool may have a gripping feature on a portion of its outer surface.

Figure 11:
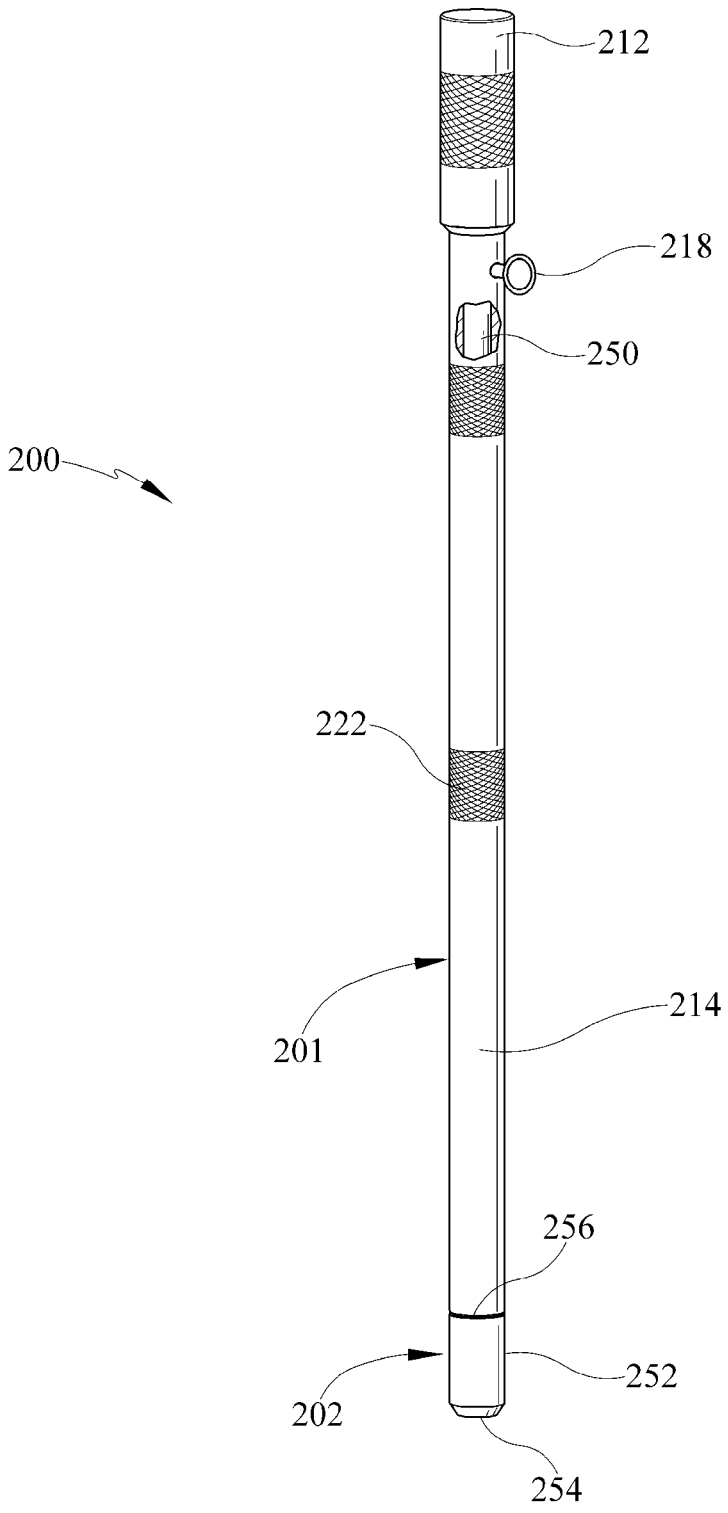
FIG. 11 is a perspective view of a ground rod driving tool of the present disclosure having a cut-away portion.

FIG. 11 shows a perspective view of a ground rod driving tool 200 of the present disclosure. Ground rod driving tool 200 has a longitudinally extending first component part 201 with a ground rod stop 212 and a sleeve 214 extending from the stop 212. Sleeve 214 is configured to slidingly receive a portion of a ground rod 16, shown in FIG. 12.

A longitudinally extending second component part 202 has a head 252 with a first end 254 and a second end 256. The first end 254 of head 252 of second longitudinally extending component part 202 is configured to cooperate with an end portion of a ground rod 16. Second end 256 of head 252 of the longitudinally extending second component part 202 has a guide rod 250 extending therefrom, shown in FIG. 13. Guide rod 250 is configured to be slidingly received by sleeve 214 of first component part 201.

First component part 201 a mass sufficient to drive ground rod 16 into the ground by sliding sleeve 214 about ground rod 16 and impinging ground rod 16 with ground rod stop 212. First component part 201 is configured to drive ground rod 16 into the ground by sliding sleeve 214 about guide rod 250 and impinging second end 256 of head 252 of longitudinally extending second component part 202.

Second end 256 of head 252 of longitudinally extending second component part 201 and the end of sleeve 214 have matingly impinging surfaces. First longitudinal end 254 of head 252 of second component part 201 may be chamfered. Ground rod driving tool 200 may have a coupler 218 configured to removably couple first component part 201 with second component part 202. Coupler 218 may have a pin configured to removably extend into aligned apertures in sleeve 214 and guide rod 250. A portion of an outer surface of first component part 201 may have a gripping feature 222. For example, outer portions of first component part 201 may be knurled or have other features for gripping, 222.

Figure 12:
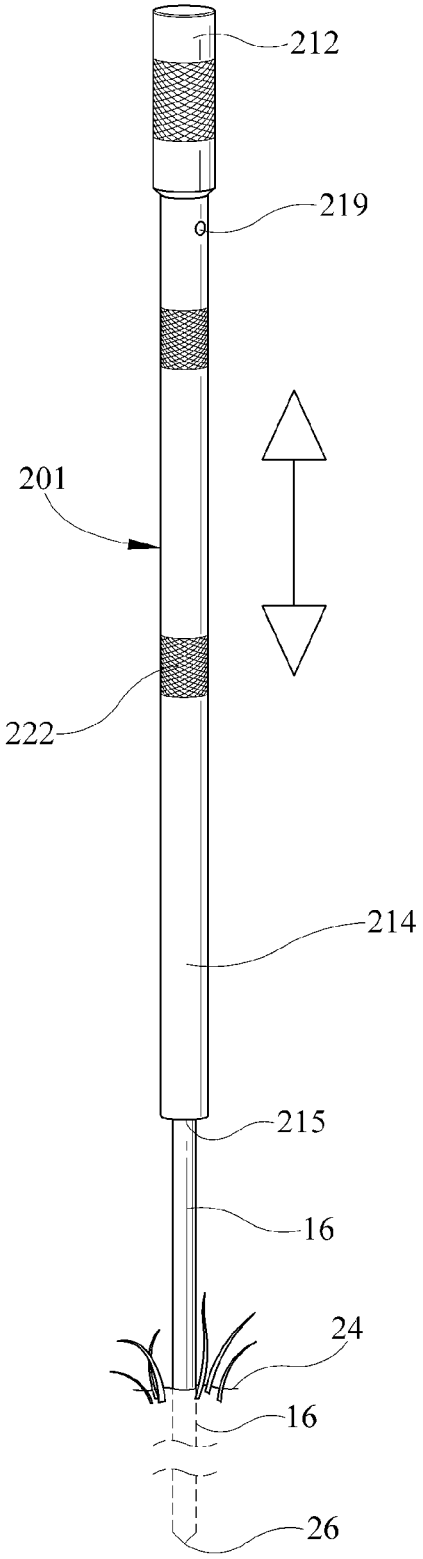
FIG. 12 is a perspective view of a component part of the ground rod driving tool of the present disclosure showing it driving a ground rod into the ground.
Figure 13:
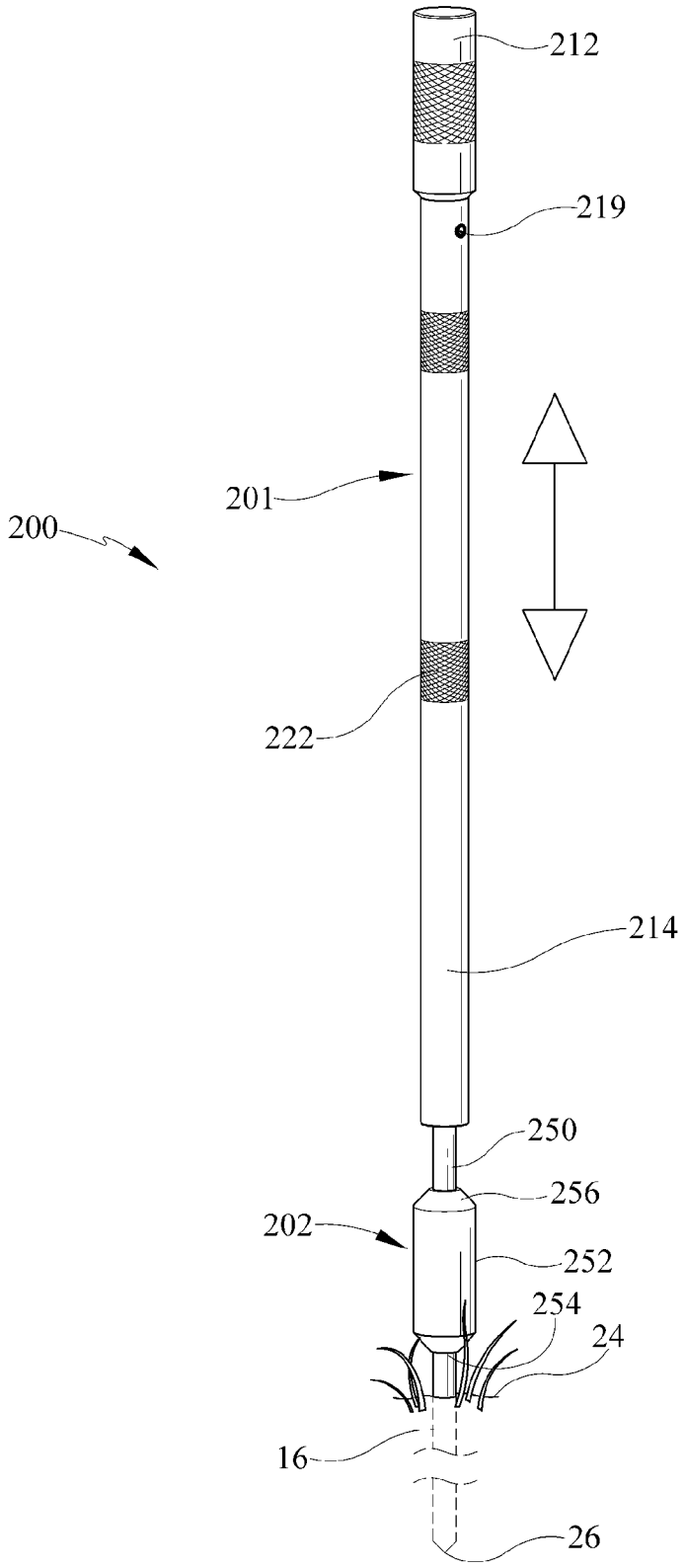
FIG. 13 is a perspective view of two component parts of the ground rod driving tool of the present disclosure showing them cooperatively driving a ground rod into the ground.

FIGS. 12 and 13 are perspective views of component parts of ground rod driving tool 200 showing cooperation of the component parts and a method of driving ground rod 16 into the ground 24. First component part 201 may first be uncoupled from second component part 202. This may be carried out by removing pin 218 from apertures 219 and 259, shown in FIG. 14.

Ground rod 16 may be driven into ground 24 by first positioning a first end 26 of ground rod 16 on ground 24. A portion of a second end of ground rod 16 may be received with sleeve 214. Sleeve 214 may then be repeatedly slid up and down about ground rod 16 and impinged with ground rod stop 212, thereby transferring the momentum of first component part 201 to the ground rod 16 and driving ground rod 16 into the ground until sleeve 214 becomes proximate ground 24.

First component part 210 may then be removed from ground rod 16. Guide rod 250 may then be received with sleeve 214. First end 254 of head 252 may then be cooperated with ground rod 16. For example, first end 254 may have a recess configured to receive a portion of an end of ground rod 16. Then sleeve 214 may be repeatedly slid up and down about guide rod 250 and impinged with the second end of the head 256, thereby transferring the momentum of first component part 201 to second component part 202, and then transferred to ground rod 16. Ground rod 16 may be driven into ground 24 until a second end of ground rod 16 becomes proximate to ground 24.

Upon driving ground rod 16 into ground 24 a desired depth, first component part 210 may be coupled with second component part 202. The coupled ground rod driving tool may then be disposed to be moved, to a new location for example. A portion of an outer surface of first component part may have a gripping feature 222 which may aid gripping and sliding sleeve 214 up and down.

Figure 14:
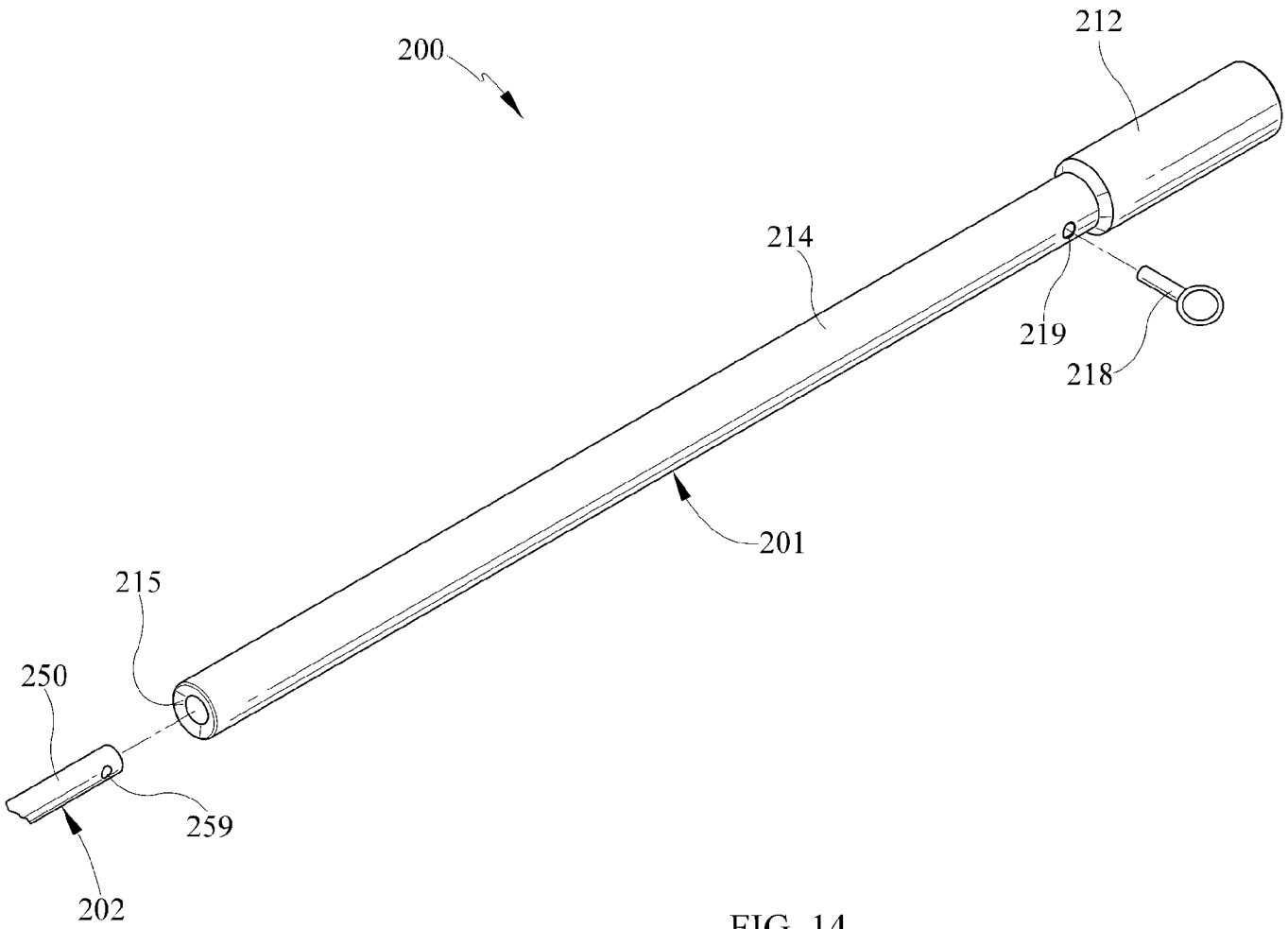
FIG. 14 is a perspective exploded view of portions of the ground rod driving tool of the present disclosure showing cooperation between component parts.
Figure 15:
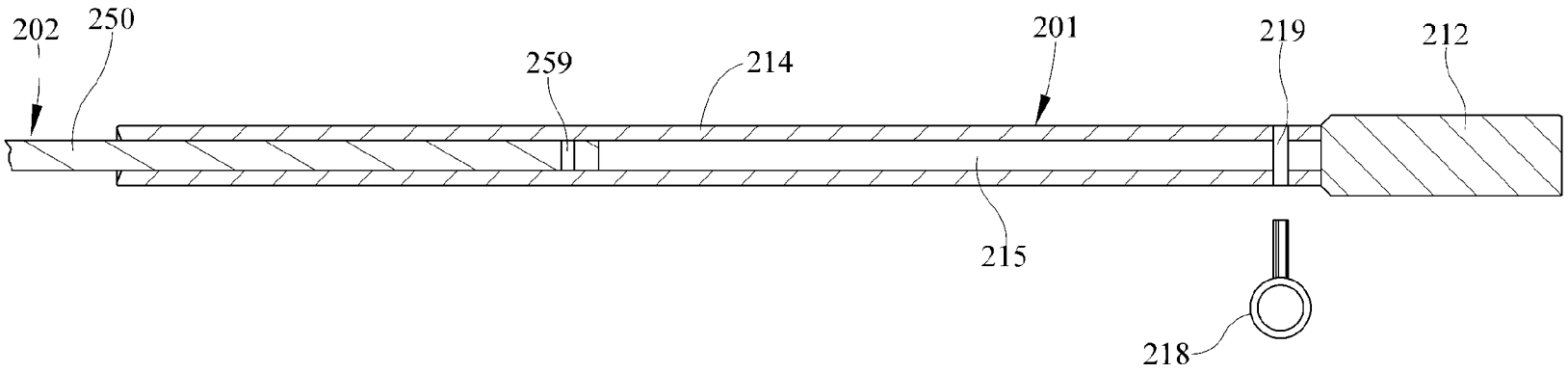
FIG. 15 is a cross-sectional view of the ground rod driving tool of the present disclosure showing cooperation of its component parts.

FIGS. 14 and 15 show an exploded and cross-sectional view, respectively, of portions of ground rod driving tool 200 of the present disclosure showing cooperation between first component part 201 and second component part 202. Guide rod 250 has an outer diameter less than an inner diameter of sleeve 214. In this respect, guide rod 250 is configured to slide into and be received by sleeve 214. Guide rod 250 has an aperture 259, shown in FIG. 16, proximate an end thereof. Aperture 259 is disposed in guide rod 250 wherein it may be aligned with aperture 219, when guide rod 250 is fully, or substantially fully, received with sleeve 214. Upon aligning aperture 259 with aperture 219, coupler 218 may then be inserted into apertures 219 and 259 and removably couple first component part 201 with second component part 202. Coupler 218 may be a pin or other coupling device as is known by persons having ordinary skill in the art. For example, coupler 218 may be a ring pin, such as a "Ring Pin, Detent", supplied by W.W Grainger, Inc. of Lake Forest, Ill.

Ground rod stop 212 may comprise a solid extension of sleeve 214. For example, ground rod stop 212 may have a mass sufficient to provide first component part 201 with a sufficient mass to drive ground rod 16 into the ground, upon sliding sleeve 214 up and down about ground rod 16 or guide rod 250. In at least one embodiment of the present disclosure, ground rod stop 212 comprises a solid extension of sleeve 214 and has an outer diameter greater than an outer diameter of sleeve 214.

First component part 201 may have a center of gravity in a central third of its length. Such a configuration may further enable a user to grasp and place sleeve 214 about ground rod 16, or guide rod 250, with a single hand. The end of sleeve 214 configured to impinge with head 252 may have a surface configured to mate with second end 256 of head 252. For example, the end of sleeve 214 may be flat or conical and second end 256 of head 252 may be flat or reverse conical.

Figure 16:
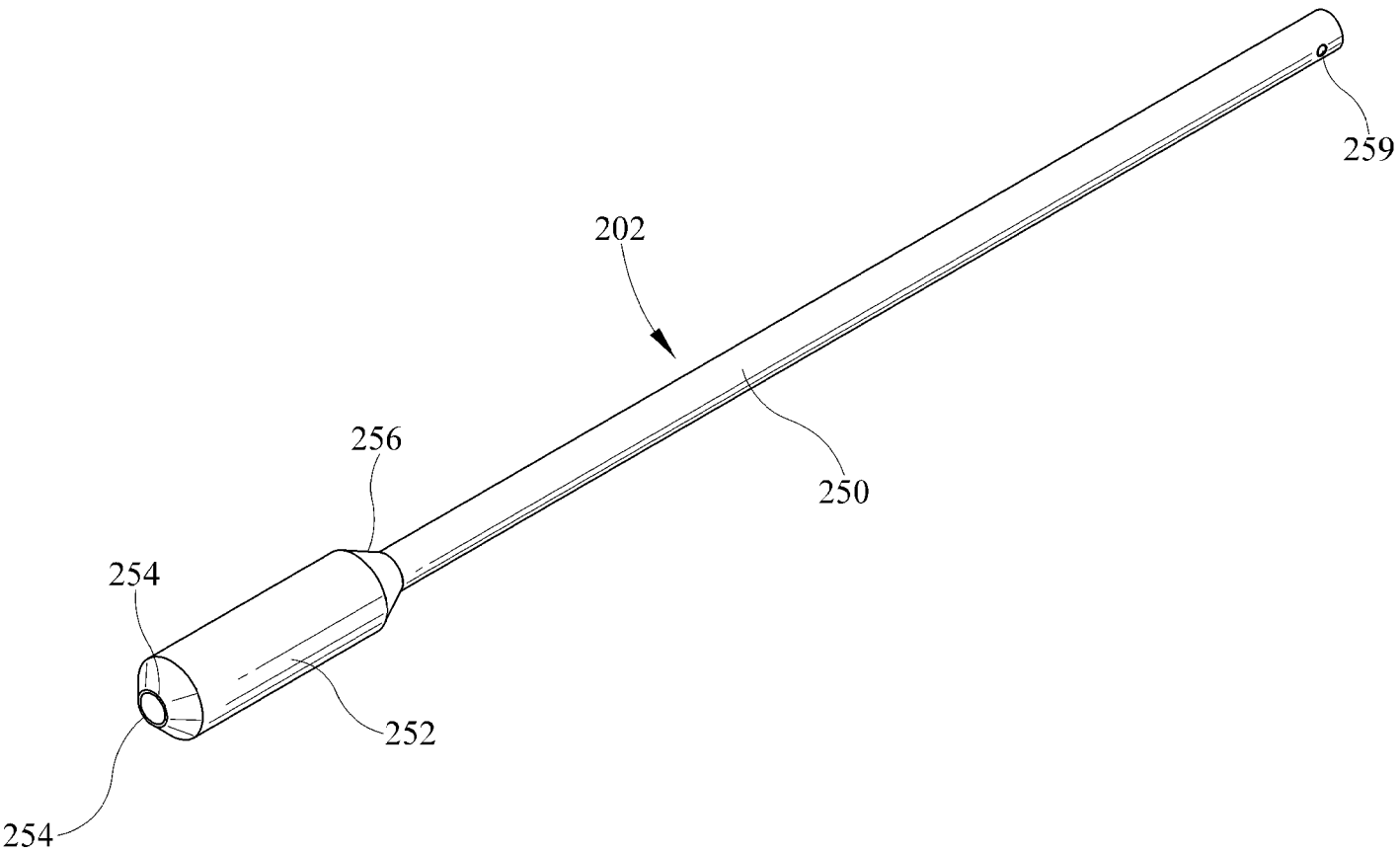
FIG. 16 is a perspective view of a component part of the ground rod driving tool of the present disclosure.

FIG. 16 is a perspective view of second component part 201 of ground rod driving tool 200. First longitudinal end 254 of head 252 may be chamfered. A chamfered end 254 may aid in driving head 252 below grade of ground 24, thus further enabling driving ground rod 16 into ground 24 to become substantially level with or below grade. Second longitudinal end 256 may have a surface configured to mate with an impinging end of sleeve 214. For example, second end 256 of head 252 may be flat or conical and the impinging end of sleeve 214 may be flat or conical in an opposite direction.

First longitudinal end 254 of head 252 may comprise an outer surface configured to cooperate with an end of ground rod 16. For example, first longitudinal end 254 may have an indentation, aperture, concave surface, or other configuration for cooperating with an end of ground rod 16.

NOMENCLATURE

Ground rod driving tool 10, 11
Second component part or ground rod cover 12, 112
First component part 14
Ground rod 16
Pin 18
First component part aperture 19
Second ground rod end 20
Knurling or gripping feature 22
Ground 24
First ground rod end 26
Threaded female coupler 30, 130
Non-threaded portion 31, 131
Threaded coupler or dowel 32
Dowel aperture 33
Sleeve 34
Chamfer 35, 135
Stop 37
Hammer 38
Portion of sleeve 39

The invention claimed is:

1. A ground rod driving tool comprising:

a longitudinally extending first component part comprising a ground rod stop and a sleeve extending from the stop, the sleeve being configured to slidingly receive a portion of a ground rod;

a longitudinally extending second component part comprises a head with a first end and a second end;

wherein, the first end of the head and the second end of the head are on opposite ends of the head;

the first end of the head is configured to receive an end of a ground rod;

the second end of the head has a guide rod extending therefrom, the guide rod being configured to be slidingly received by the sleeve of the first component part;

the first component part being configured to drive a ground rod into the ground by sliding the sleeve about the ground rod and impinging the ground rod with the ground rod stop; and the first component part being configured to drive a ground rod into the ground by sliding the sleeve about the guide rod and impinging the second end of the head.

2. The ground rod driving tool of claim 1 wherein the second end of the head and the end of the sleeve have matingly impinging surfaces.

3. The ground rod driving tool of claim 1 wherein the second end of the head and the end of the sleeve have flat or conical impinging surfaces.

4. The ground rod driving tool of claim 1 further comprising a coupler configured to removably couple the first component part with the second component part.

5. The ground rod driving tool of claim 4 wherein the coupler comprises a pin configured to removably extend into aligned apertures in the sleeve and the guide rod.

6. The ground rod driving tool of claim 1 wherein the first end of the head of second component part is chamfered.

7. The ground rod driving tool of claim 1 wherein the stop comprises a solid extension of the sleeve.

8. The ground rod driving tool of claim 7 wherein the solid extension of the sleeve has a diameter greater than an outer diameter of the sleeve.

9. The ground rod driving tool of claim 1, wherein the first component part has a center of gravity in a central third of its length.

10. The ground rod driving tool of claim 1, wherein at least a portion of an outer surface of the first component part has a gripping feature.

11. A method for driving a ground rod into the ground comprising the steps of:

positioning a first end of a ground rod end on ground;

receiving a portion of a second end of the ground rod with a sleeve longitudinally extending from a first component part of a ground rod driving tool;

repeatedly sliding the sleeve up and down about the second end of the ground rod and impinging a ground rod stop, thereby transferring the momentum of the first component part of the ground rod driving tool to the ground rod and driving the ground rod into the ground until the sleeve becomes proximate the ground;

removing the first component part of the ground rod driving tool from the ground rod;

receiving a guide rod extending from a second end of a head of a second component part of the ground rod driving tool in the sleeve;

receiving the second end of the ground rod with a first end of the head of the second component part; and repeatedly sliding the sleeve up and down about the guide rod and impinging the second end of the head, thereby transferring the momentum of the first component part to the second component part, and then to the ground rod and driving the ground rod into the ground until the second end of the ground rod becomes proximate to the ground.

12. The method for driving a ground rod into the ground of claim 11 further comprising a step of coupling the first component part with the second component part of the ground rod driving tool, performed after the step of repeatedly sliding the sleeve up and down about the guide rod.

13. The method for driving a ground rod into the ground of claim 11 further comprising a step of uncoupling the first component part from the second component part of the ground rod driving tool, performed prior to the step of receiving a portion of a second end of the ground rod with a sleeve.

14. A ground rod driving tool comprising:

a longitudinally extending first component part comprising a sleeve configured to receive a portion of a ground rod and a ground rod stop;

a longitudinally extending second component part having a first longitudinal end and a second longitudinal end, wherein the first longitudinal end is configured to receive an end of a ground rod;

the first component part and the second component part being configured to couple and uncouple with each other, and have their longitudinal axes aligned upon coupling;

the first component part having a mass sufficient to drive a ground rod into the ground by sliding the sleeve about the ground rod and impinging the ground rod stop; and the second component part being configured to transfer a driving force to a ground rod and drive the ground rod into the ground.

15. The ground rod driving tool of claim 14, wherein the second end of the second component part has a guide rod extending therefrom, the guide rod being configured to be slidingly received by the sleeve of the first component part.

16. The ground rod driving tool of claim 15, wherein the first component part is configured to drive a ground rod into the ground by sliding the sleeve about the guide rod and impinging the sleeve with the second end of the second component part.

17. The ground rod driving tool of claim 15 further comprising a coupler configured to removably couple the first component part with the second component part, wherein the coupler comprises a pin configured to removably extend into aligned apertures in the sleeve and the guide rod.

18. The ground driving tool of claim 14, wherein the second end of the second component part and the end of the sleeve have matingly impinging surfaces.

19. The ground rod driving tool of claim 14 further comprising a coupler configured to removably couple the first component part with the second component part.

20. The ground rod driving tool of claim 14 wherein the first longitudinal end of the second component part is chamfered.

* * * * *